United States Patent [19]

Henri

[11] Patent Number: 4,924,068

[45] Date of Patent: May 8, 1990

[54] STEAM GENERATOR

[75] Inventor: Benon Henri, Sceaux, France

[73] Assignee: A.R.M.I.N.E.S., Paris, France

[21] Appl. No.: 274,325

[22] Filed: Nov. 18, 1988

[30] Foreign Application Priority Data

Nov. 19, 1987 [FR] France ..... 87 160022

[51] Int. Cl.[5] ..... F22B 1/28

[52] U.S. Cl. ..... 219/274; 219/272

[58] Field of Search ..... 219/271–276, 219/285, 324, 333, 362; 261/142

[56] References Cited

U.S. PATENT DOCUMENTS

| | | | |
|---|---|---|---|
| 2,140,516 | 12/1938 | Cowan | 219/274 |
| 4,419,302 | 12/1983 | Nishino et al. | 261/142 |
| 4,532,413 | 7/1985 | Ahonen | 219/285 |
| 4,748,314 | 5/1988 | Desage | 219/271 |

FOREIGN PATENT DOCUMENTS

| | | | |
|---|---|---|---|
| 2341340 | 9/1977 | France . | |
| 58-19901 | 2/1983 | Japan | 219/333 |
| 656203 | 6/1986 | Switzerland . | |

*Primary Examiner*—Teresa J. Walberg

*Attorney, Agent, or Firm*—McAulay, Fisher, Nissen & Goldberg

[57] ABSTRACT

A steam generator having an enclosure containing a liquid to be evaporated. A rapid evaporation module inside the enclosure comprising at least one heating electrical heating resistance housed in a porous body immersed in the liquid or located near this porous body. The generator includes an electrical gate and a device for detecting the level of the liquid to change the liquid level in the enclosure in a direct proportion to the steam output which has to be furnished, so as to lower the level when the steam output must be reduced and vice versa, and an electrical energy metering circuit to adjust the electrical energy supplied to the heating resistance in a corresponding manner.

18 Claims, 2 Drawing Sheets

STEAM GENERATOR

BACKGROUND OF THE INVENTION

1. Field of the Invention

The present invention is concerned with a steam generator comprising an enclosure containing a liquid to be evaporated and, within this enclosure, a module for rapid evaporation comprising at least one heating electrical resistance housed in a porous body immersed in the liquid to be evaporated or located near this porous body to heat the same by radiation.

2. Description of the Prior Art

Generally, most steam generators operating in industrial and household domains are used only on an average of 20 to 50% of their normal outputs. Such for example is the case with industrial or household humidifiers. The units used in the latter application comprise generally an enclosure containing liquid to be evaporated, which is usually water, maintained at a constant level by a level regulator in such a way that the resistance is constantly immersed in the water to be evaporated. Generally, these devices comprise systems which automatically and periodically control the cleaning cycle of these enclosures in which mud accumulates and also cycles for eliminating lime which adheres to the surface of the body of the resistances and which is broken by overheating in the absence of water. The production of the steam is monitored by a hydrometric probe which controls an on and off basis for the operation of the boiler, through a device which ensures passage of electric current in the resistance.

Such devices have the primary drawbacks of requiring a steam start up time which is relatively long when starting from the cold state or after these cycles of cleaning and of calcium elimination and of having a response time which does not permit proper regulation of the steam output while also producing a steam which contains suspended droplets of water; requiring a sophisticated control system and resistances of the highest quality when the sheet of lime is destroyed. Moreover, should such devices be equipped with energy metering devices, the transfer times then would be considerably increased by the presence of a large volume of water when operating with small or average power in the heating resistance. These devices are relatively expensive to manufacture and to operate while producing a mediocre quality of steam owing to its moisture content, with response times which are very lengthy.

Additionally, it is known that lime accumulation and the hardness of the lime deposited onto the surface of the resistance shorten its life and causes delays in thermal transfer times and a loss in energy production. Contrariwise, by combining porous bodies with the surface of the resistance, it is noted that lime no longer is deposited on one surface, as is the case with the surface of the resistance when the latter is used alone, but in the three-dimensional volume constituting the porous body and that this lime has a spongy consistency which is no longer very hard for the same duration of operation, which therefore lessens the drawbacks previously mentioned. Also known is the absorption power of the porous bodies, their pumping and capillary capacities as well as the volume distribution of the liquids in proportion to the height of the pumping. It is also known that by combining porous bodies with heating sources the exchange coefficients are thereby considerably increased and there is obtained a relatively short response time. As is described in French Patents FR-A-2,341,330 and FR-A-2,420,731 it has already been proposed to use porous bodies that are made to function in steam generators by immersing a porous body, equipped with an internal electrical resistance in a permanent water layer.

SUMMARY OF THE INVENTION

The present invention is concerned with improvements in devices of this latter type for the purpose of improving their performance by a better way of producing steam; by reducing the time for obtaining such; by producing a quantity of steam which is practically free of water droplets and by considerably increasing the operating time between two lime elimination cycles.

To this effect, this steam generator comprises an enclosure containing a liquid to be evaporated and inside of this enclosure, there is contained a rapid evaporation module comprising at least one electric heat resistance housed in a porous body immersed in the liquid or located near this porous body and is characterized in that it comprises means for varying the level of the liquid in the enclosure in a direction proportional to the steam output which has to be furnished, that is, in order to lower the level when the steam output must be reduced and vice versa and means for correspondingly adjusting the electrical energy fed to the heat resistance.

BRIEF DESCRIPTION OF THE DRAWINGS

There will be described hereafter by way of nonlimiting examples, various embodiments of the present invention, reference being had to the accompanying drawing on which.

DESCRIPTION OF THE PREFERRED EMBODIMENTS

Figure 1:
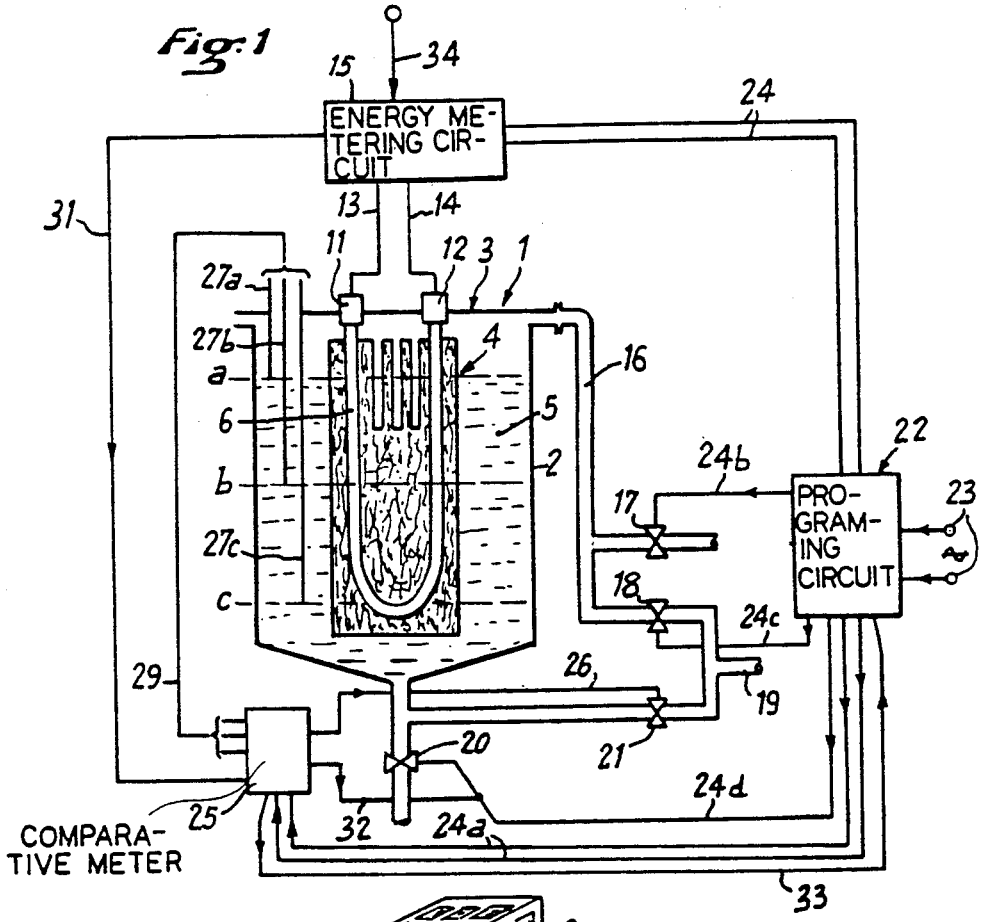
FIG. 1 is a flow diagram of a steam generator comprising a rapid evaporation module immersed vertically in the liquid to be evaporated, in accordance with the invention.
Figure 2:
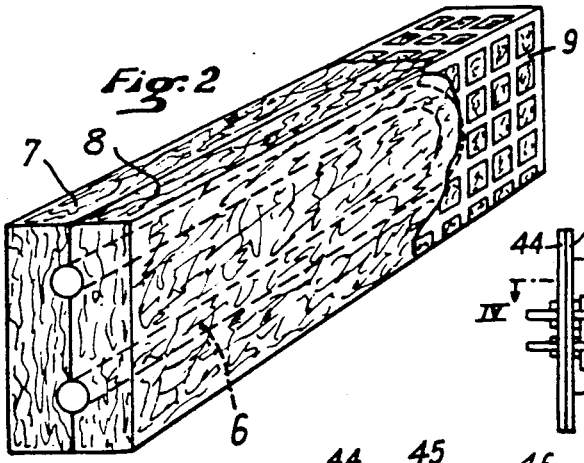
FIG. 2 is a perspective view of a rapid evaporation module useful in the steam generator shown in FIG. 1.

The steam generator according to one embodiment of the invention as shown in FIG. 1 comprises a boiler 1 whose operation is controlled by several external elements. This boiler 1 comprises an enclosure 2 closed at its upper part by a cover 3 to which is vertically suspended a rapid evaporation module 4 for liquid 5, such as water, contained in enclosure 2 of boiler 1. Rapid evaporation module 4 as indicated on FIG. 2 comprises one or several electrical heating resistances 6 which have a hairpin shape. The electrical resistance 6 is housed within a porous body which has a parallelepipedal shape and is formed of two half-shells 7,8 placed side by side. The porous body is made, for example, from semi-rigid rock wool which has been previously cut to desired dimensions from a layer thereof. This porous body is maintained compressed against internal resistance 6 by an external screen 9 which has large meshes. Resistance 6 can have a power of 1 kW, a right section having a diameter of 10 mm and a developed length of 60 cm, as well as an inter-axial distance when the same is shaped as a hairpin, of 30 mm. This porous body, for example, can have a volumetric mass 108 kg/m$^3$ and the rock fibers forming it can have, in this example, a size which lies mostly around 1.5 to 5 micrometers in diameter with about 1.5 to 15 mm in length. These fibers are deposited by forming a stratification and are placed on the resistance in such a way that the steam flux takes place vertically. The porous body formed by the two half-shells 7,8 preferably comprises a binder improving its impregnation and the capillary ascent of the liquid to evaporate. The two half-shells 7,8, for example, have a length of 30 cm and exceeding 2 cm on the side of the extreme lower rounded part of the resistance, a horizontal dimension or width of 8 cm and a thickness, each, of 3 cm. These two half-shells thus cover the resistance along the same distance on its periphery while being maintained compressed by the large sized screen 9. The porous body 4 is also perforated in its upper central part by three vertical blind holes 10 forming chimneys for the escape of the steam produced.

As can be seen from on FIG. 1, the rapid evaporation module 4 constituted by resistance 6 and the two half-shells 7,8 of the porous body, is suspended within enclosure 2 from cover 3 and extends downwardly up to a certain distance from the bottom of the enclosure 2. The upper ends of the two branches are the hairpin shaped resistance 6 respectively connected to two insulated cross-members 11,12 carried by cover 3 and are connected electrically to two feed conductors 13,14 coming from an electrical energy metering circuit 15.

Enclosure 2 of boiler 1 is connected at its upper part to a tubing 16 to which an electric gate 17 and electric gate 18 are connected in parallel. Electrical gate 17 is used for evacuating steam and electric gate 18 is used to cause the entrance of rinse and cleaning water in the enclosure from a feed pipe 19.

The lower part of the enclosure is equipped with a channel on which is connected an electric gate 20 for evacuating rinse or cleaning water and which is connected also through an electric gate 21 for metering water flowing in to be evaporated to the feed channel 19.

The control installation for the steam generator also comprises an operating and programming circuit 22 which is connected to an electric feed network 23 by feeding, according to the required program, the energy meter 15 through conductors 24, a comparative meter 25 for admitting water to be evaporated by conductors 24*a*, the electric gates 17, 18, 20 through respective conductors 24*b*, 24*c*, and 24*d*. Electric gate 21 is supplied electrically from the comparative meter 25 through conductor 26.

The control installation also comprises two level pick ups passing through cover 3 and extending to variable depths inside boiler 1. In the non-limiting embodiment shown, the steam generator comprises a device 27 for detecting the level of the liquid to be evaporated in enclosure 2. This device 27 comprises as many level detectors as there are liquid levels and consequently outputs of steam which must be provided. In the non-limiting embodiment presently described, the device comprises three level pick ups 27*a*, 27*b*, 27*c* which extend lower and lower along this order within boiler 1, in order to determine respectively the presence of an upper liquid layer *a*, an intermediate liquid layer *b* and a lower liquid level *c*. The three level detectors 27*a*, 27*b*, 27*c* are connected to the comparative metering circuit 25 through electric conductors 29. This comparative metering circuit 25 is also connected to the electrical energy metering circuit 15 through electrical conductor 31 to electric gate 20 through conductor 32 and to circuit 22 by conductor 33.

DESCRIPTION OF OPERATION OF THE INVENTION

The operation of the steam generator which has just been described, is as follows: To start the commencement, operation and programming circuit 22 triggers the opening of electric gate 21 through conductor 26 of measuring comparing circuit 25, identified as comparative meter, so that water can penetrate into enclosure 2 of boiler 1 until its level reaches the upper level *a* (See FIG. 1. At this moment, the upper level detector 27*a* comes into play through the agency of measuring comparing circuit 25 to close water inlet electric gate 21. The rapid heating and evaporating module 4 thereby is impregnated with water on practically its entire height up to upper level a and above this level owing to capillary effect. The fact that the upper level a has been reached is denoted by a signal transmitted by the measuring and comparing circuit 25 to the operating and programming circuit 22 through conductor 33. Circuit 22 then actuates the energy measuring circuit 15 which in turn triggers electric feed of the heating resistance 6. This resistance transmits its heat to the water contained in the porous body 7,8 which has in its upper part above the upper water level a, a small amount of water which thus is very rapidly evaporated. The water leaving this zone is replaced by capillary effect with water in the lower part of the porous body. The vertical holes or chimneys 10 facilitate evacuation of steam while avoiding local excess pressures. The steam produced is evacuated through channel 16 and electric gate 17 towards the place where it will be used.

When after a certain period of operation it becomes necessary to clean the evaporation enclosure 2, the program of circuit 22 actuates, through conductors 24, interruption of heating control circuit 15 and through conductors 24*a* and 26, the closing of vaporizable water admission electric gate 21 as well as electric gate 17 through conductor 24*b*. Then electric gates 20 and 18 open by the action of the respective conductors 24*d* and 24*c* which makes it possible, during the required period, to eliminate the mud and the lime which have accumulated at the bottom of the vat and in the evaporating element.

Figure 3:
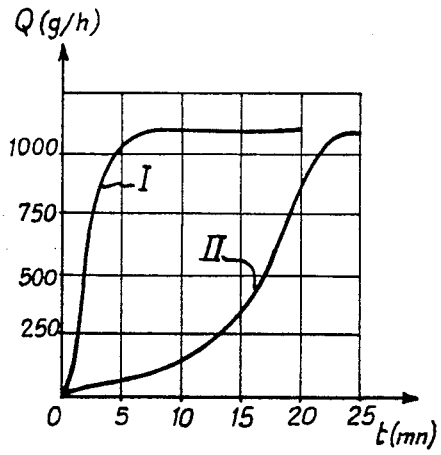
FIGS. 3 and 4 are diagrams illustrating the operation of the steam generator according to the invention.

The steam generator according to the invention makes it possible to produce vapor very rapidly by comparison with a boiler whose bare resistance is immersed in an equivalent amount of water. The graph of FIG. 3 evidences this effect. On this graph, the amount of vapor produced, in grams per hour, is shown along the ordinate while the time t, in minutes, is shown along the abscissa. It can be seen on this graph that the time required for a constant flow of steam is about 6 minutes for a steam generator according to the invention (curve I), while it is of 23 minutes for a conventional steam generator (curve II).

Figure 4:
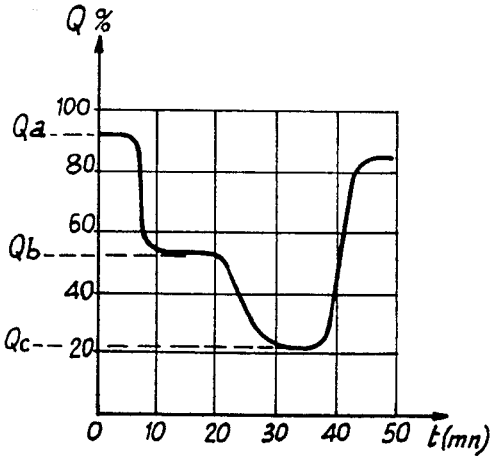

The graph of FIG. 4 shows the steam output variation obtained with a steam generator according to the invention when an external probe imposes an operating cycle to the energy meter 15 of the circuit. This external probe is shown schematically as 34 on FIG. 1 and is connected to the energy metering circuit 15. In the graph of FIG. 4, vapor output Q is expressed as a percentage of the maximum output along the ordinate. Time t is shown along the abscissa in minutes. The power of the resistance combined with the porous body corresponds to the instantaneous steam output Q. It can be seen in the graph of FIG. 4 that the steam output is maintained constant at 90% (output Qa) of the maximum output for 3 minutes. During this time, the resistance 6 has a power equal to 90% of its maximum power and the steam generator operates with water at the upper level *a* in enclosure 2. At the end of the first 5 minutes period, probe 34 causes a reduction in the energy dissipated by resistance 6 to arrive at a power for this resistance equal to 50% of the maximum power and consequently to a vapor output Qb equal to 50% of the maximum output. The energy metering circuit 50 sends through conductor 31 a signal to the comparing metering circuit 25. The latter then actuates through conductor 26 closing of the water inlet electric gate 21 in order for lowering the level of water in enclosure 2 through outflow thereof. This lowering of the level can also be obtained by evacuating water; in this case, the metering-comparing circuit 25 emits a signal through conductor 32 for causing electric gate 20 to open which gate 20 is connected to the water discharge line. Operation at 50% of maximum steam output is obtained with a level of water stabilized to intermediate level b in enclosure 2 which is detected by intermediate level pick up or detector 27*b*. Otherwise stated, from this time on, the steam generator operates with a power for the electric heat resistance 6 equal to 50% of maximum power and a level of water level reduced to intermediate level b. At the end of 20 minutes, probe 34 causes a new reduction in steam output which will fall to the minimum value Qc. The signal emitted by the probe 34 causes a new reduction of the energy furnished by the metering circuit 15 to resistance 6 whose power then falls to 20% of its maximum power. Simultaneously the metering circuit 15 actuates, through conductor 31, the comparing and metering circuit 25 to further lower the level within enclosure 2 by drainage or emptying, until lower level c is reached, which is detected by the lower level detector 27*c*. From this moment on, that is beginning substantially with the 30th minute, the steam generator produces a steam output equal to 20% of the maximum output, starting with water maintained at lower level c in enclosure 2. Beginning with the 35th minute, probe 34 produces a steam output of Qc. The electric energy measuring circuit 15 accordingly feeds more electricity to resistance 6 so that it can operate at a power equal to 85% of maximum. Simultaneously the comparing-metering circuit 25 again opens electric gate 21 to bring up the water level in enclosure 2. It is seen in the graph of FIG. 4 that the steam output then increases very rapidly. The device according to the invention, therefore, makes it possible to follow very closely any change of standard in the steam output whether this standard is automatically imposed by a probe 34 or caused by manual operation of energy meter 15.

Figure 5:
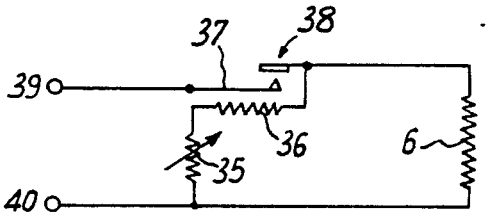
FIG. 5 is an electric current diagram of a cyclic metering device for electrical energy used in the steam generator of the invention.

FIG. 5 is an electrical circuit diagram of a conventional cyclical energy metering circuit 15 of the electrothermal type and commercially available under the name of "Simmerstat". This device makes it possible to change the energy produced between 0 and 100%. This type of device can be used when it is desired manually to change the steam output. It can be made automatic by an electronic servo system. In the manually operated type, periodic operation is obtained by adjusting a variable resistance 35 which increases or decreases the electric current feeding a heat resistance 36 integral with a bi-metallic strip thermal switch 37. This switch 37 by thermal inertia and during a period more or less long shuts off an electrical contact 38 connected in series with resistance 6 of the steam generator and that of heat resistance 36 in relation with the thermal inertia of switch 37. The voltage of the electrical feed sector is applied between the terminals 39 and 40 respectively connected to switch 37, itself in series with contact 38 and to one end of a variable resistance 35 which is in series with the heat resistance 36. These two resistances 35 and 36 are themselves connected in series and then as a unit in parallel with resistance 6 of the steam generator.

Figure 6:
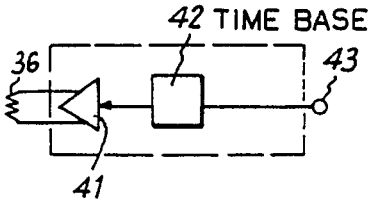
FIG. 6 is a circuit diagram of another embodiment of the electrical energy meter.

The simple and sturdy cyclic energy meter shown in FIG. 5 can be made automatic by using an electronic control such as that shown in FIG. 6. In this case, the heat resistance 36 of switch 37 is connected to a transistorized amplifier 41 itself controlled by a time base 42 connected to a humidity probe 43. This makes it possible to regulate the steam output of a boiler for humidifying the ambient air in proportion to the humidity of the air by putting under control the energy meter of the circuit 15.

Figure 7:
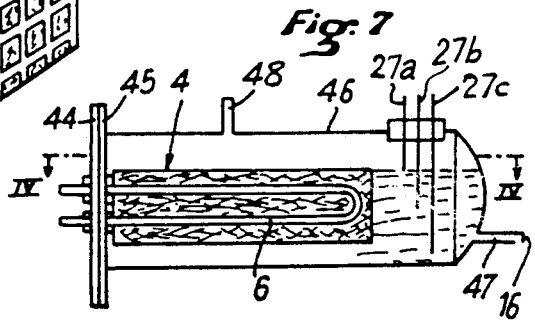
FIG. 7 is a vertical cross-sectional view of the boiler in which the rapid evaporation module operates horizontally.
Figure 8:
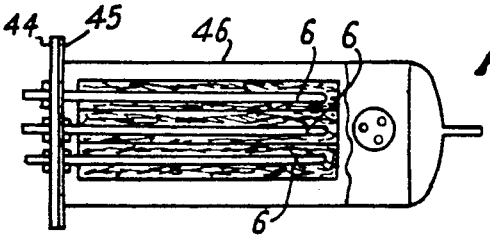
FIG. 8 is a cross-section made along line VIII—VIII of FIG. 7.

In the modification of the invention shown in FIGS. 7 and 8, the evaporating body 4 extends horizontally inside a boiler which itself operates horizontally. In this embodiment, the rapid evaporation module 4 includes three hairpin resistances 6 parallel to one another and housed respectively in a porous body placed side by side and which are carried together by the same vertical plate 44 which closes one end of the boiler. This plate 44 is secured with an intermediate sealing joint to a collar 45 welded to tubular enclosure 46 of the horizontal boiler. This boiler has a water inlet tube 47 at its lower portion, a steam output tube 48 at its upper part and three vertical level detectors 27*a*, 27*b*, 27*c*, to provide the required depth of water.

In all the embodiments of the invention which have been previously described, it is possible to use any type of porous body made from natural or synthetic materials and which by transforming have channels, cells or cavities having capillary action. It is possible to position inside these porous bodies or on every part of their surfaces thermally insulated walls. For example, the porous body can have one such wall on its periphery which goes beyond slightly the upper part and extending to its lower part in such a way that the water in which the device is immersed must come in through the lower part. Similarly, it is possible, for example, to close the lower part by providing a water inlet section which is compatible with the steam output along the range sought.

With respect to the resistances, it is possible to use a resistance of any type other than that of the hairpin type, for example, of the cartridge type. It is possible to add to this resistance diffusion fins in order to distribute the heat fluxes. In those cases the compatible depths of water required are adjusted with the steam output range sought.

It is also possible to adjust the depth of the water progressively in proportion with the steam outputs used by control of the measurement of the resistivity of a water column localized in the feed volume of the device.

It is possible to use, as an energy meter any type of electro-mechanical or electronic meter supplying any form of electric current having appropriate cycles.

The steam generator of the invention can be used with any boiler already in operation or to be built to evaporate any liquid, and it can be used in assemblies or installations to improve the thermal transfer times, the space occupied and the energy consumption when electric resistances are used.

While there has been shown and described what is considered to be the preferred embodiments of the invention, various changes and modifications may be made without departing from the scope of the invention.

What is claimed is:

1. A steam generator comprising:

an enclosure containing a liquid to be evaporated;

a rapid evaporation module inside said enclosure;

a porous body immersed in said liquid, means to vary the liquid level in the enclosure in a direct proportion with the vapor output to be furnished for decreasing the level when the steam output must be reduced and vice versa;

said means for varying the liquid level within said enclosure comprising a device for detecting the level of the liquid to be evaporated, said device comprising a level detector for each plurality of liquid levels, and different vapor output amounts for each said liquid level;

each said level detector being connected to a comparative metering circuit for controlling the operation of a metering electric gate for admitting liquid into said enclosure;

an electric gate for evacuating excess water; and means correspondingly to adjust the electrical energy fed to the heating resistance, said last-mentioned means being formed by an electric metering circuit connected to the comparative metering circuit.

2. Steam generator according to claim 1, comprising:

an electric supply network (23);

an operating and programming circuit (22) connected to said electric supply network (23) and connected to said means (15) including said electric metering circuit and to said comparative metering circuit (25);

said programming and operating circuit (22) also being connected to an electric gate (17) for evacuating steam, to said electric gate (20) for evacuating excess water or for a cleaning cycle and also to an electric gate (18) for providing water during the cleaning cycle.

3. Steam generator according to claim 2, comprising an outer probe (34) connected to said means (15) including said electrical metering circuit to effect a modification in the output of steam produced.

4. Steam generator according to claim 3, wherein said means (15) including the cyclic energy metering circuit comprises a contact (38) connected in series with the heating resistance (6), and a switch (37) for controlling said heating resistance (6), said switch (37) being heated by a resistance (36).

5. Steam generator according to claim 4, wherein said energy metering circuit comprises a manually adjustable variable resistance (35), connected in series with a resistance (36) for heating said switch (37).

6. Steam generator according to claim 5, wherein said resistance (36) for holding said switch (37) is connected to an amplifier (41); said amplifier (41) being controlled by a time base (42) connected to a humidity probe (43) for controlling the operation of said energy metering circuit and thereby controlling the steam output produced in proportion to the humidity in the air.

7. Steam generator according to claim 2, wherein said means (15) including the cyclic energy metering circuit comprises a contact (38) connected in series with the heating resistance (6), and a switch (37) for controlling said heating resistance (6), said switch (37) being heated by a resistance (36).

8. Steam generator according to claim 7, wherein said energy metering circuit comprises a manually adjustable variable resistance (35), connected in series with a resistance (36) for heating said switch (37).

9. Steam generator according to claim 8, wherein said resistance (36) for heating said switch (37) is connected to an amplifier (41); said amplifier (41) being controlled by a time base (42) connected to a humidity probe (43) for controlling the operation of said energy metering circuit and thereby controlling the steam output produced in proportion to the humidity in the air.

10. Steam generator according to claim 1, comprising an outer probe (34) connected to said means (15) including said electrical metering circuit to effect a modification in the output of steam produced.

11. Steam generator according to claim 10, wherein said means (15) including the cyclic energy metering circuit comprises a contact (38) connected in series with the heating resistance (6), and a switch (37) for controlling said heating resistance (6), said switch (37) being heated by a resistance (36).

12. Steam generator according to claim 11, wherein said energy metering circuit comprises a manually adjustable variable resistance (35), connected in series with a resistance (36) for heating said switch (37).

13. Steam generator according to claim 12, wherein said resistance (36) for heating said switch (37) is connected to an amplifier (41); said amplifier (41) being controlled by a time base (42) connected to a humidity probe (43) for controlling the operation of said energy metering circuit and thereby controlling the steam output produced in proportion to the humidity in the air.

14. Steam generator according to claim 1, wherein said means (15) including the cyclic energy metering circuit comprises a contact (38) connected in series with the heating resistance (6), and a switch (37) for controlling said heating resistance (6), said switch (37) being heated by a resistance (36).

15. Steam generator according to claim 14, wherein said energy metering circuit comprises a manually adjustable variable resistance (35), connected in series with a resistance (36) for heating said switch (37).

16. Steam generator according to claim 15, wherein said resistance (36) for heating said switch (37) is connected to an amplifier (41); said amplifier (41) being controlled by a time base (42) connected to a humidity probe (43) for controlling the operation of said energy metering circuit and thereby controlling the steam output produced in proportion to the humidity in the air.

17. Steam generator according to claim 1, wherein said energy metering circuit comprises a manually adjustable variable resistance (35), connected in series with a resistance (36) for heating said switch (37).

18. Steam generator according to claim 17, wherein said resistance (36) for heating said switch (37) is connected to an amplifier (41); said amplifier (41) being controlled by a time base (42) connected to a humidity probe (43) for controlling the operation of said energy metering circuit and thereby controlling the steam output produced in proportion to the humidity in the air.

* * * * *

UNITED STATES PATENT AND TRADEMARK OFFICE

CERTIFICATE OF CORRECTION

PATENT NO. : 4,924,068

DATED : May 8, 1990

INVENTOR(S) : Henri RENON

It is certified that error appears in the above—identified patent and that said Letters Patent is hereby corrected as shown below:

Title page: under "Inventor:", change "Benon" to --Renon--.

Signed and Sealed this

Fifteenth Day of October, 1991

*Attest:*

HARRY F. MANBECK, JR.

*Attesting Officer*

*Commissioner of Patents and Trademarks*